US012146275B2

(12) United States Patent
Zhang et al.

(10) Patent No.: US 12,146,275 B2
(45) Date of Patent: Nov. 19, 2024

(54) LONG-SERVICE-LIFE PWS CABLE WITH REPLACEABLE SLEEVE AND SHIELDING GAS

(71) Applicants: CCCC SECOND HARBOR ENGINEERING COMPANY LTD., Wuhan (CN); CCCC WUHAN HARBOR ENGINEERING DESIGN AND RESEARCH INSTITUTE CO., LTD., Wuhan (CN)

(72) Inventors: Hong Zhang, Wuhan (CN); Wei Wang, Wuhan (CN); Zhiyong Shi, Wuhan (CN); Chaoran He, Wuhan (CN); Yongtao Zhang, Wuhan (CN); Shaofang Li, Wuhan (CN); Guotai Yan, Wuhan (CN); Xianpeng Hu, Wuhan (CN); Xinyue Dou, Wuhan (CN)

(73) Assignees: CCCC SECOND HARBOR ENGINEERING COMPANY LTD., Wuhan (CN); CCCC WUHAN HARBOR ENGINEERING DESIGN AND RESEARCH INSTITUTE CO., LTD., Wuhan (CN)

( * ) Notice: Subject to any disclaimer, the term of this patent is extended or adjusted under 35 U.S.C. 154(b) by 717 days.

(21) Appl. No.: 17/593,756

(22) PCT Filed: Nov. 28, 2019

(86) PCT No.: PCT/CN2019/121526

§ 371 (c)(1),
(2) Date: Sep. 23, 2021

(87) PCT Pub. No.: WO2020/199625

PCT Pub. Date: Oct. 8, 2020

(65) Prior Publication Data

US 2022/0127803 A1 Apr. 28, 2022

(30) Foreign Application Priority Data

Apr. 1, 2019 (CN) ..... 201910256311.7
Apr. 1, 2019 (CN) ..... 201920427558.6

(51) Int. Cl.
*E01D 19/16* (2006.01)
*E01D 11/04* (2006.01)
(Continued)

(52) U.S. Cl.
CPC ..... *E01D 19/16* (2013.01); *E01D 11/04* (2013.01); *E01D 19/14* (2013.01); *E01D 22/00* (2013.01)

(58) Field of Classification Search
CPC ..... E01D 19/16; E01D 19/14; E01D 22/00; E01D 11/04
See application file for complete search history.

(56) References Cited

U.S. PATENT DOCUMENTS 3,602,633 A * 8/1971 Miller ..... H01B 9/022 174/126.2
4,193,319 A * 3/1980 Langford ..... D07B 1/162 74/502.5
(Continued)

FOREIGN PATENT DOCUMENTS

CN 1456742 A * 11/2003
CN 1458333 A * 11/2003
(Continued)

*Primary Examiner* — Abigail A Risic
(74) *Attorney, Agent, or Firm* — CBM PATENT CONSULTING, LLC

(57) ABSTRACT

A long-service-life PWS cable with replaceable sleeve and shielding gas. It consists of wire strands, wrapping tape covering the wire strands, and a sheath arranged outside the wire strands, and is characterized in that the sheath is covered with an outer protective sleeve and shielding gas is filled between the wires in the wire strands. The wire strands
(Continued)

Figure 1:
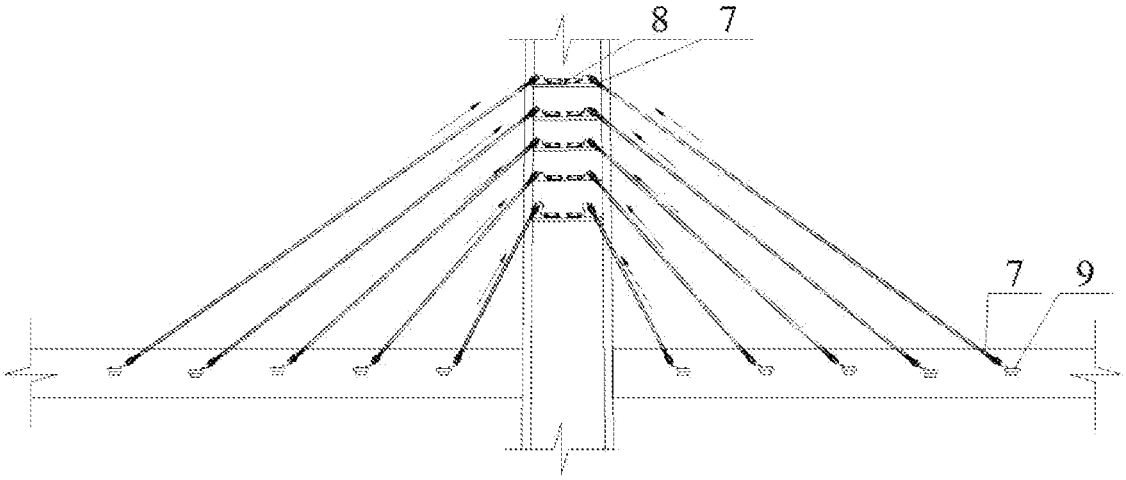

of the present invention is completely under protection in a shielding gas environment which effectively avoids the corrosion of the wire strands; the protective sleeve outside the sheath of the PWS cable is a replaceable segmented and fragmented sleeve structure, which is convenient to be replaced and installed, substantially prolonging the service life of the PWS cable system with great promotional value achieved.

20 Claims, 5 Drawing Sheets

(51) Int. Cl.
*E01D 19/14* (2006.01)
*E01D 22/00* (2006.01)

(56) References Cited

U.S. PATENT DOCUMENTS 4,347,401 A * 8/1982 Knudsen ..... H02G 5/063 174/14 R
4,550,559 A * 11/1985 Thomson ..... B29C 48/13 57/215
2008/0250576 A1* 10/2008 Brand ..... E04C 5/10 29/897
2020/0232171 A1* 7/2020 Fabry ..... D07B 5/005
2020/0395711 A1* 12/2020 Klein ..... H01R 24/005

FOREIGN PATENT DOCUMENTS

CN 1644791 A * 7/2005
CN 100354471 C * 12/2007
CN 109944158 A * 6/2019

* cited by examiner

LONG-SERVICE-LIFE PWS CABLE WITH REPLACEABLE SLEEVE AND SHIELDING GAS

FIELD OF THE INVENTION

The invention relates to the technological field of bridge structures, in particular to a long-service-life PWS cable with replaceable sleeve and shielding gas.

BACKGROUND ART

The cable is generally used as stress-bearing component of cable-stayed bridge and is also applicable to high-rise buildings for structural stabilization. The cable is generally located outside the structure and exposed to the natural environment on a long-term basis. The steel wire inside the cable body is in a high stress state for a long time and is particularly sensitive to corrosion. In the event of slight corrosion or damage, its safety and reliability will be greatly compromised. For structures with long design life and high requirements for use with other special functionalities, higher requirements are put forward for cable durability, corrosion resistance and aesthetics. Therefore, it is required that the cable structure, including the part in the anchoring area, shall be protected with measures from corrosion and for durability while integrating with the main structure and the surrounding environment to form an urban landmark.

At present, the main anti-corrosion measures for the cable body include steel wire surface galvanization, wrapping tape around the wire tendons for stress corrosion prevention and then the surface of the cable covered with extruded polyethylene sheath. In practical engineering, if the cable body is corroded due to damage to the sheath and material aging, it will affect the safety of the structure, reduce the cable life and increase the maintenance and even replacement cost of the cable. For lighting demanded to adhere to the cable structures, lighting devices and cables directly installed on the surface of cable structure will affect the appearance of the cable structure and the heat emitted will also affect the service life of the cable.

Thus, in view of the anti-corrosion problem of the cable body, there are patents that propose a scheme to protect the cable body with shielding gas. For instance, a Chinese invention patent named "A Device for Steel Wire Stay Cable Protective" with patent number "CN103835235B", of which the outer layer of the steel wire rope is wrapped with a polyester tape and its outer layer is covered with hollow-structured polyethylene sheath filled with inertial gas. Such solution is good for protecting the steel wire rope, and the inertial gas filled is able to isolate the air and avoid corrosion to the steel wire rope. The hollow-structured polyethylene sheath is double-layered filled with shielding gas. The inner layer covers on steel wire tendons, and the outer layer is used for protection. Moreover, zinc powder is filled into the gap between the steel wires. Owing to the hollow structure, the loading capacity of the sheath is reduced, especially the impact resistance against sand and wind load, which affects the service life of the cable. The zinc powder filled between the steel wires result in increasing the self-weight of entire cable, which will have a negative impact on the overall design and construction of the bridge (building).

In response to this situation, there is a Chinese utility model patent named "Bridge Cable Filled with Shielding Gas" with patent number "CN208309381U". It is a solution for cable by filling with shielding gas, which includes cable strands, anchor socket and protective layer. The strands are composed of steel wires, of which both ends are fixed with an anchor socket in respective and the outer surface of the strands is covered with a protective layer. It also consists of gas hood, quick connector, gas tube, and temperature-hygrometer and barometer. By cutting off part of the protective layer at both ends of the cable strands near the anchor socket, the cable strands in the area where the protective layer is removed will be exposed to atmospheric environment. The two areas with notches on the protective layer are used for connecting gas tube and the detection port, respectively; the gas hood equipped with an observation window is clamped outside the protective layer, by which the gas tube and detection port are covered. The gas hood at the gas tube is connected through a quick connector, and the gas hood at the detection port is connected to the temperature-hygrometer and barometer through the quick connectors respectively. The shielding gas is introduced into the strands with gas tube through the gas hood. It is equivalent to adding a gas refilling device to the cable strands to monitor the cable strands' gas injection and ensure that the cable strands are always immersed in the shielding gas. This structure can indeed protect the cable strands. During the implementation, the protective layer must be cut to expose the strands. However, as the protective layer of the existing strands (steel strands) consists of two layers, one layer is covered with polyester tape (high-strength polyester tape) wrapped around the wire strands, and the other layer is a polyethylene sheath. The cutting notches of the protective layer will reduce integrity of the protective layer, on the other hand, the polyester tape (high-strength polyester tape) after being cut away partially will disintegrate the entire covering structure, reducing the service life of the entire cable and bringing safety hazards.

In addition, the service life of the existing bridge stay cables (including cable rope) is less than 50 years. If sheath is damaged, the entire cable has to be replaced. So far, there has been no bridge stay cable (including cable rope) that can last for one hundred years.

BRIEF SUMMARY OF THE INVENTION

The purpose of the invention is to provide a long-service-life PWS (Parallel Wire Strands) cable with replaceable sleeve and shielding gas to allow the cable (including cable strands) to have life span of one hundred years by replacing the sleeve and introducing shielding gas to protect the wire strands, thereby solving the problems of the prior art.

The technological solution of the invention is to introduce a long-service-life PWS cable with replaceable sleeve and shielding gas, which includes a wire strands, a wrapping tape covering the wire strands, and a sheath arranged outside the wire strands, characterized in protecting the sheath with outside the outer protective sleeve and filling the gap between the wires of the cable with shielding gas.

The outer surface of the wire constituting the wire strands is provided with a protective layer, the shielding gas is filled gap between the wires in the wire strands, the sheath is a permanent structure, and the outer protective sleeve is a replaceable structure.

The outer protective sleeve includes at least two tube segments connected to form a tube shape, and a connecting structure is provided between adjacent tube segments.

The outer protective sleeve includes a plurality of sleeve units spliced and connected in an axial direction, and the multi-section outer protective sleeve is conducive to be installed onto the surface of the PWS cable in situ.

The outer protective sleeve is installed after the cable erected and fitted with the sheath, and the outer protective sleeve can be replaced separately.

The connecting structure includes a bayonet connecting portion provided between the two tube segments.

The connection structure includes a hinge connection structure between the two tube segments and a bayonet connection part. The two pieces are hingedly connected, and the bayonet connection part is used for facilitating the installation and removal after the tube is combined.

Electric heating element for bonding and connecting the tube segments is provided.

The tube segment is provided with a plurality of lamp installation slots, which is convenient for lamp installation.

The tube segment is provided with a plurality of weight-reducing holes which can be sued for heating unit installation.

It also includes anchors which are arranged at both ends of the wire strands and the sheath, the two ends of the sheath or the wire strands between the two anchors are in the enclosed space where the shielding gas is filled.

A pressure sensor for detecting the pressure of the shielding gas is provided.

Sheaths and/or anchors are connected to the inflation tube.

The inflation tube is connected with the inflation device to provide shielding gas for the inside of the wire strands.

The above-mentioned multiple sleeve units refer to sleeves that may include tube segments and connecting parts.

Advantages of the present invention: 1. The wire is directly immersed in the shielding gas which can well isolate the air and avoid the corrosion of the wire;

2. The present invention owing to a two-layer protective structure and a device with a replaceable outer protective sleeve greatly improves the service life of the entire cable system by replacing the protective sleeve;

3. The outer protective sleeve of the present invention is of a simple structure which is convenient to install and disassemble as well as connect together by quick splicing regardless of axial direction or radial direction;

4. The outer protective sleeve of the present invention can be welded and connected as a whole by means of hot melt through two tube segments along with installation method being simple and efficient;

5. The wire strands of the present invention is made of new high-strength, low-relaxation and corrosion-resistant materials with stronger corrosion resistance, galvanized aluminum alloy steel wire is used;

6. Nitrogen, inertial gas or other shielding gas is filled the gap between the wires in the wire strands to make the internal condition of the wire strands up to the C1 standard;

7. Pressure sensor is installed at the anchor head at one end of the PWS cable to detect the gas pressure inside the cable body, and by controlling the inlet pressure, the air pressure in the cable body can be ensured to be always a bit greater than the outside atmospheric pressure, allowing the wire strands to be always in a dry and stable environment;

8. Mounted segmented and fragmented protective sleeve jacketed outside the cable body is available to increasing protective strength of the cable structure. Moreover, it is independent of the cable body and can be replaced separately. By replacing the outer protective sleeve, the inner sheath can be well protected to ensure the long service life of the stay cable system.

9. The lighting unit of the present invention can be installed in the lamp slot reserved on the outer protective sleeve without directly contacting the cable body, which not only prolongs the cable life, but also ensures the aesthetic looking of the cable structure.

10. The heating unit of the present invention can be installed in the weight-reducing hole reserved on the outer protective sleeve without directly contacting the cable body nor affecting the service life of the sheath. The running of the heating unit in icy and snowy weather solves the icing problem of cable body, while ensuring the aesthetic looking of the cable structure.

The wire strands of the present invention is completely under protection in a shielding gas environment which effectively avoids the corrosion of the wire strands; the protective sleeve outside the PWS cable is a replaceable segmented and fragmented sleeve structure, which is convenient to replace and install, largely extending the service life of the stay cable system with great marketing value.

BRIEF DESCRIPTION OF FIG.

Figure 2:
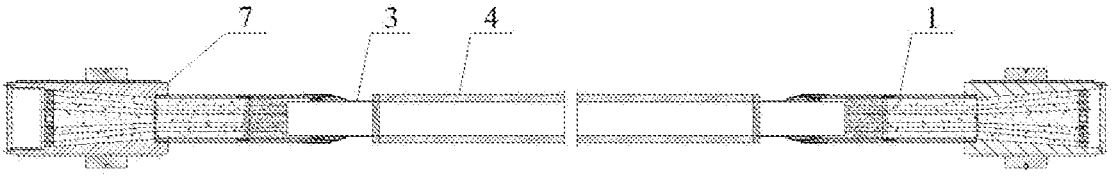
Figure 3:
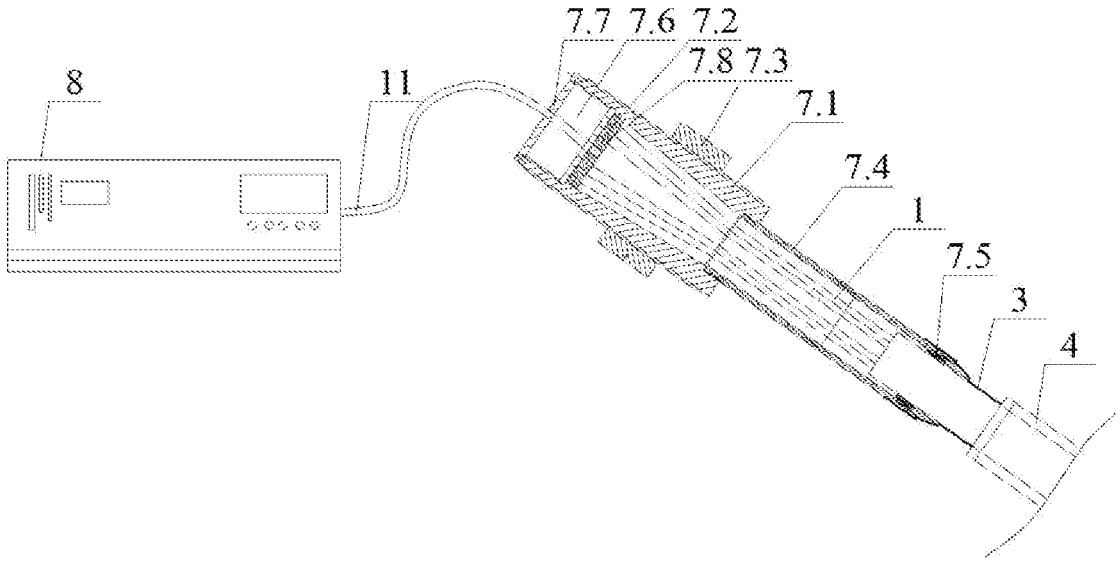
Figure 4:
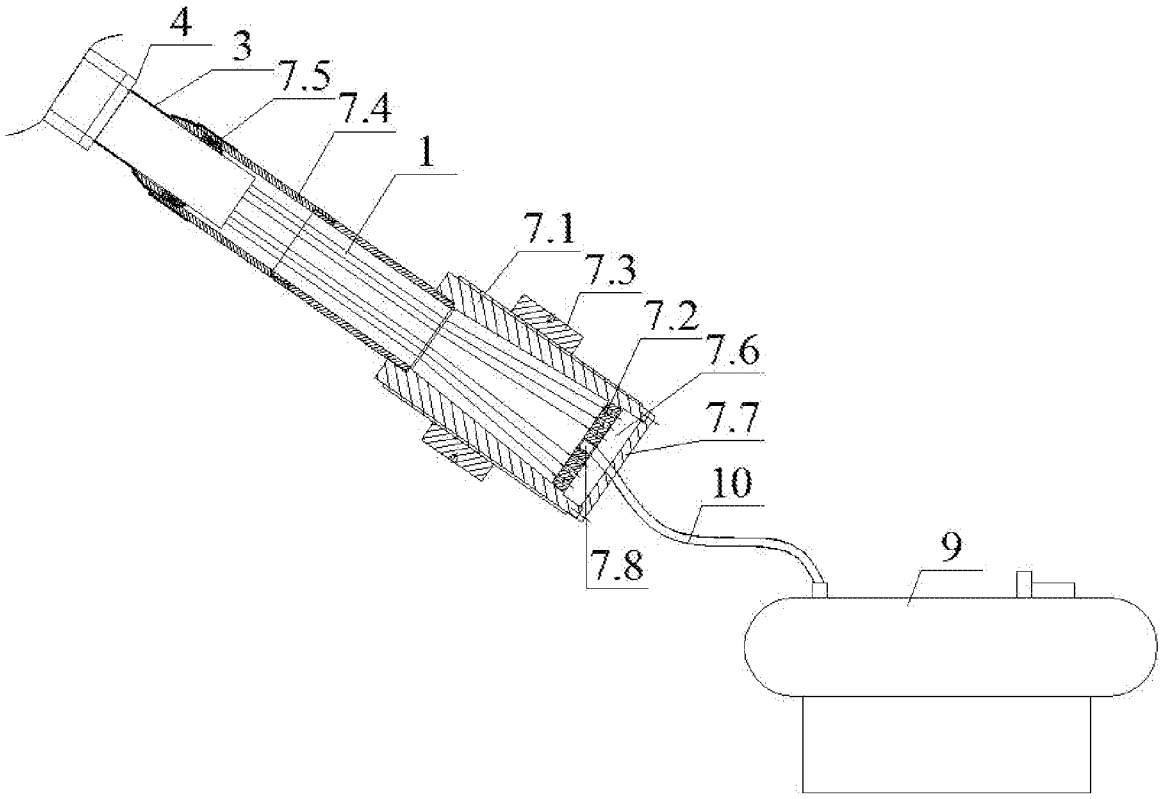
Figure 5:
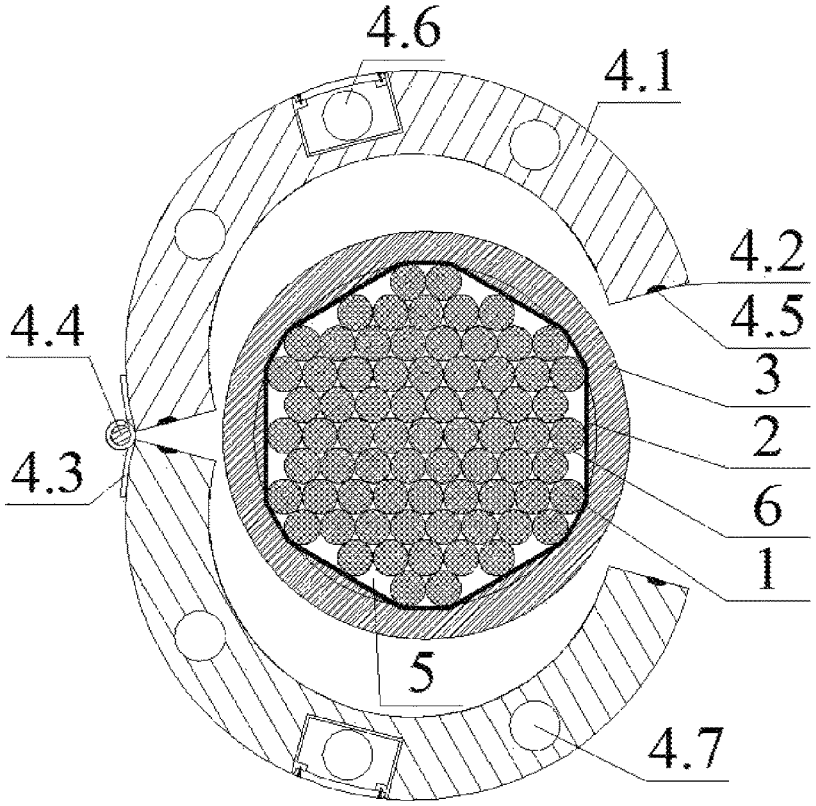
Figure 6:
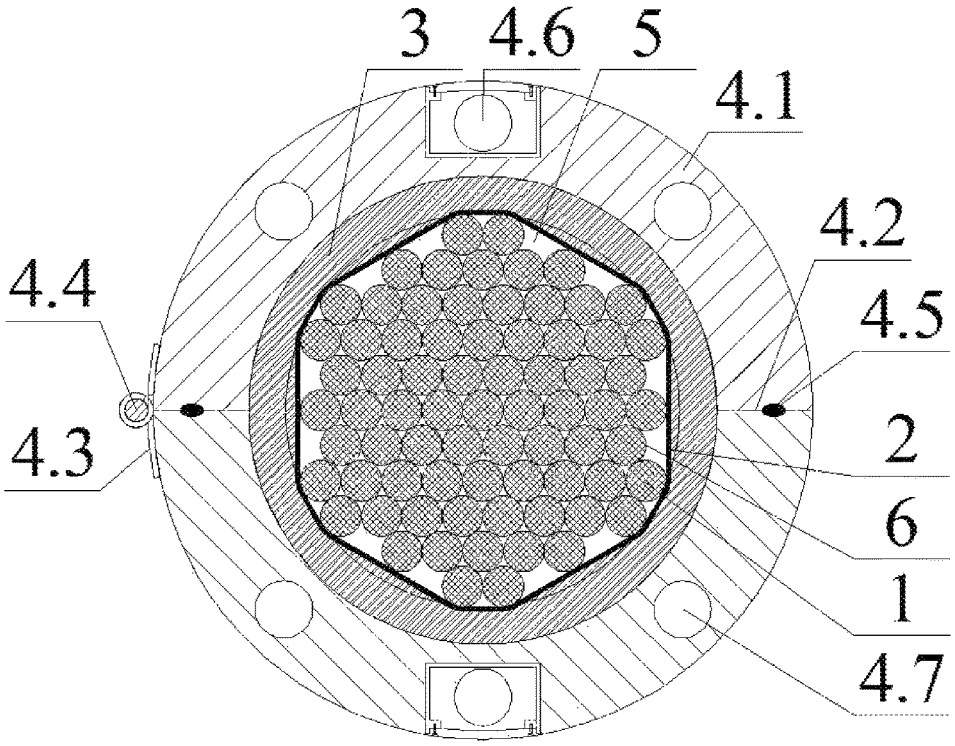
Figure 7:
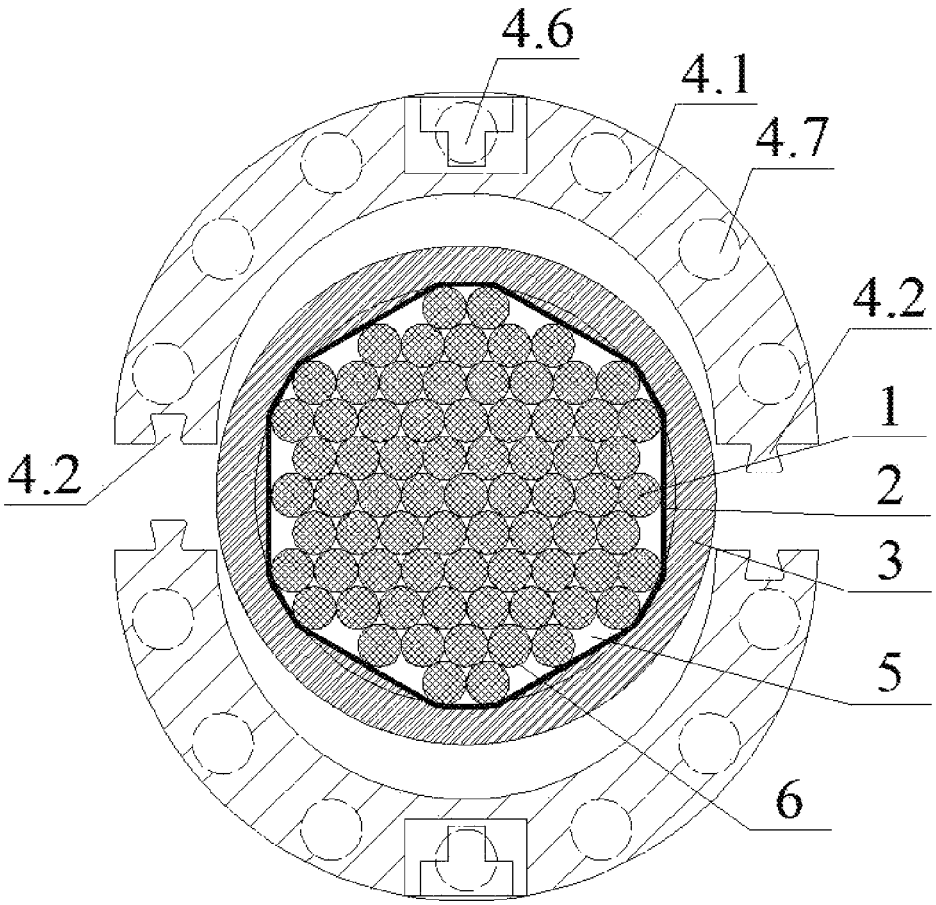
Figure 8:
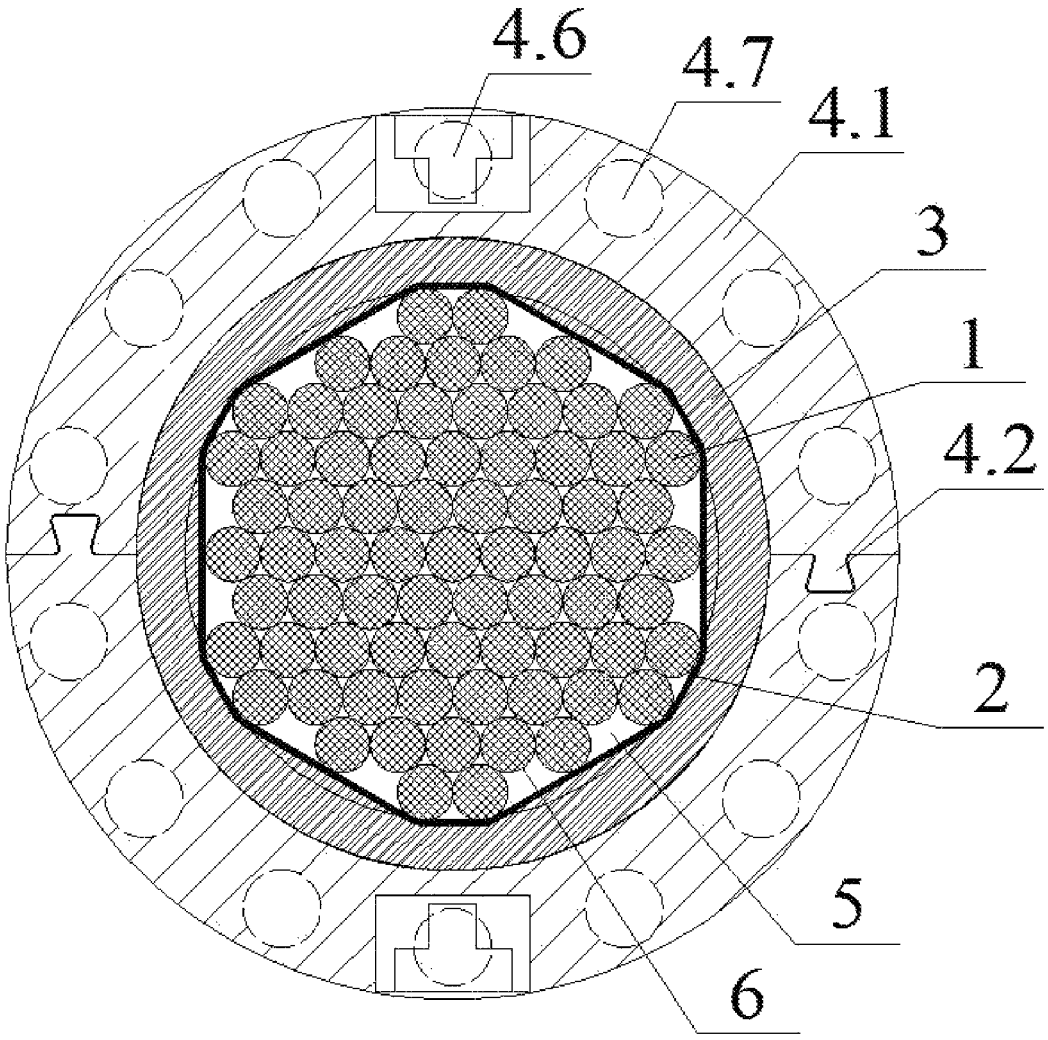

FIG. 1: Schematic Diagram of Installation Structure of Stay Cable;

FIG. 2: Schematic Diagram of Overall Installation Structure of Stay Cable;

FIG. 3: Schematic Diagram of Connecting Structure between Pressure Sensor and Anchor;

FIG. 4: Schematic Diagram of Connecting Structure of Inflation Device and Anchor;

FIG. 5: Schematic Diagram of Installation Structure of Outer Protective Sleeve and Wire strands when Bayonet Connection in the First Case (when the segment is opened);

FIG. 6: Schematic Diagram of Installation Structure of Outer Protective Sleeve and Wire strands when Bayonet Connection in the First Case (when the segment is closed);

FIG. 7: Schematic Diagram of Installation Structure of Outer Protective Sleeve and Wire strands when Bayonet Connection in the Second Case (when the segment is opened);

FIG. 8: Schematic Diagram of Installation Structure of Outer Protective Sleeve and Wire strands when Bayonet Connection in the Second Case (when the segment is closed);

Wherein: 1—wire strands; 2—wrapping tape; 3—sheath; 4—outer protective sleeve; 4.1—segment; 4.2—bayonet connection; 4.3—loose leaf; 4.4—rotating shaft; 4.5—electric heating components; 4.6—lamp installation slot; 4.7—weight-reducing hole;

5—shielding gas; 6—protective layer; 7—anchor; 7.1—anchor socket; 7.2—anchor plate; 7.3—nut; 7.4—connecting sleeve; 7.5—seal ring; 7.6—hollow space; 7.7—cover plate; 7.8—through-hole; 8—pressure sensor; 9—inflation device; 10—inflatable tube; 11—connecting tube.

DETAILED DESCRIPTION OF THE INVENTION

The present invention is further described in detail below in conjunction with the FIG. and specific embodiments.

As shown in FIG. 1-8, regarding the long-service-life PWS cable with a replaceable sleeve and shielding gas, the cable body of this embodiment includes wire strands 1, wrapping tape 2 wound around the wire strands 1, and high-density polyethylene sheath 3, the wire strands 1 is formed by parallel multiple wires with slight spiral, and the wire strands 1 has a protective layer 6 on the surface. The protective layer 6 in this embodiment is a zinc-aluminum alloy coating, the wire diameter can be 5 mm, 7 mm or other diameter specifications that meet the replacement of the cross-section, characterizing with high strength and low relaxation. The wrapping tape 2 of this embodiment is characterized with high strength, corrosion resistance and easy winding, such as a double-layer polyester film sandwiched with a layer of high-strength fiber yarn, etc., and the high-density polyethylene sheath 3 has a single-layer or double-layer structure, which is permanent and not replaceable.

In this embodiment, shielding gas 5 is injected into the wire strands 1, as shown in FIG. 5-6, the shielding gas 5 is filled between the wires of the wire strands 1, that is, the wire strands 1 is directly in contact with the shielding gas 5 which isolates the air outside to a void rusting of wire strands 1. In this embodiment, the wire strands 1 and the sheath 3 are provided with anchors 7 at both axial ends, and the wire strands 1 and the sheath 3 are connected and fixed to the bridge structure through the anchors 7. The wire strands 1 at both ends of the sheath 3 or between the two anchors 7 are in the enclosed space where the shielding gas is filled.

As shown in FIGS. 3 and 4, the anchor 7 of this embodiment includes an anchor socket 7.1. A tapered hole is axially outfitted inside the anchor socket 7.1. The large end of the tapered hole is fitted with an anchor plate 7.2, the outer circumference of the anchor socket 7.1 is threaded with a nut 7.3, and the anchor socket 7.1 is also provided with a convex ring at the small end of the tapered hole. The axial ends of the connecting cylinder 7.4 are respectively connected to the anchor socket 7.1 and the sheath 3 extending into the connecting cylinder 7.4. A sealing structure is provided between the sheath 3 and the connecting cylinder 7.4. The sealing structure can be a sealing ring or a seal washer. A sealing structure can be provided at the connection of each part of the anchor 7 to increase or realize the sealing performance of the inner space of the anchor.

The wire strands 1 is fixedly connected to the anchor plate 7.2 through the connecting cylinder 7.4 and the anchor socket 7.1. The anchor socket 7.1 of this embodiment is also provided with a convex sleeve at the large end of tapered hole, and the convex sleeve is enclosed in the hollow space 7.6 for placing the wire strands 1 passing through the anchor plate 7.2, and the head of the convex sleeve is covered with a cover plate 7.7. In this embodiment, a through-hole 7.8 is opened on the anchor plate 7.2, and the hollow space 7.6 connects with the inner space of the anchor socket 7.1 through the through-hole 7.8, that is, connecting with the inner space of the sheath 3.

According to the FIGS. 1, 3 and 4, in this embodiment, the inflation device 9 and air pressure monitoring device are respectively set on the lower and upper ends of the stay cable. The anchor socket 7.1 is connected to the inflatable tube 10, and one end of the inflatable tube 10 is connected to the internal space of the anchor socket 7.1 through the hollow space 7.6, and the other end is connected to the inflation device 9. The inflation device 9 of this embodiment located at the lower end of the stay cable supplies shielding gas for the inside of the wire strands 1, as shown in FIG. 4. To ensure that the wire strands 1 is always in an environment with shielding gas 5, the air pressure monitoring device of this embodiment includes a pressure sensor 8 for detecting the pressure of the shielding gas 5. The pressure sensor 8 is fixed on pylon and connected with the internal space of the anchor socket 7.1 with a connecting tube 11 through the hollow space 7.6 for monitoring the internal air pressure of the sheath 3, as shown in FIG. 3. After the PWS cable installation is completed, the inflation device 9 is to fill gas in bottom to top from the hollow space 7.6 at the lower end of the cable body. A pressure sensor 8 is installed at the hollow space 7.6 at the upper end of the cable body to monitor the shielding gas 5 pressure in the cable body in real time to ensure that the air pressure in sheath 3 is higher than the outside atmospheric pressure.

To improve the corrosion resistance of entire cable structure, an outer protective sleeve 4 is available to the sheath 3 in this embodiment. The sheath 3 is a permanent structure, and the outer protective sleeve 4 is a replaceable structure. The inner circumferential end surface of the outer protective sleeve 4 fits tightly on the outer circumferential end surface of the sheath 3. Both ends of the outer protective sleeve 4 are sealed with the sheath 3.

As shown in FIGS. 5 to 6, the outer protective sleeve 4 includes at least two tube segments 4.1 connected to form a tube, and a connecting structure is provided between adjacent segments 4.1. The outer protective sleeve 4 includes a plurality of sleeve units spliced and connected in the axial direction. The outer protective sleeve 4 is installed after the cable erected and fitted with the sheath, and The outer protective sleeve 4 can be replaced separately.

The connecting structure includes a bayonet connecting part 4.2 provided between two tube segments 4.1. The bayonet connection parts 4.2 of the two tube segments 4.1 are to be aligned and locked during connection, and the two tube segments 4.1 can be combined into a tubular structure. The bayonet connecting part 4.2 on the tube segments 4.1 of this embodiment has two modes. The first is as shown in FIG. 5-6. The bayonet connecting part 4.2 has a melt treated flat end surface to bond the two segments 4.1 together; the second is as shown in FIG. 7-8, which is a combination of a raised bayonet and a recessed bayonet slot. By pressing the bayonet into the bayonet slot, the two segments 4.1 can be fixed together.

Preferably, the connecting structure includes an hinged connection structure between two tube segments 4.1. The hinged connection structure of this embodiment includes a loose leaf 4.3 arranged on the outer end surface of the segment 4.1. The two segments 4.1 are rotatably hinged and connected into one body through the connecting structure of the loose leaf 4.3 and the rotating shaft 4.4 for easy installation and disassembling of the tube segment structure.

Besides, in order to increase the joint strength of the tube segments 4.1, this embodiment is provided with an electric heating element 4.5 for bonding of the tube segments 4.1, as shown in FIG. 5-6, the electric heating element of this embodiment 4.5 is an electric heating wire set between the joints of the tube segments 4.1. The bonding part is heated up by the electric heating element 4.5, so that the bonding part is hot-melt bonded together to increase the structural strength of the connected parts.

In addition, on the outer circumferential end surface of the tube segments 4.1 of this embodiment, there is a plurality of lamp mounting slots 4.6, and inside the tube segments 4.1, there is a plurality of weight-reducing holes 4.7 arranged at equal intervals along the axial direction; heating units can be installed in the weight-reducing hole 4.7.

The outer protective sleeve 4 of this embodiment is installed on the sheath 3 in sections after the installation of stay cable. The two ends of the outer protective sleeve 4 are sealed to tightly wrap the sheath 3 of the wire strands 1; the inner end surface of the outer protective sleeve 4 is closely attached to the outer end surface of the sheath 3, which is equivalent to adding a layer for stay cable body protection. The outer protective sleeve 4 has the characteristics of high strength, corrosion resistance and repairability with durability and anti-corrosion ability no lower than that of the sheath 3 under the same conditions, such as HDPE and UHDPE, etc.

When the outer protective sleeve 4 fails to provide effective protection due to aging, corrosion, damage or other reasons, it can be removed and replaced with a new outer sleeve for continuous protection.

It is believed that the fundamental principle, key features and the advantages of the present invention will be understood from the foregoing description. Technicians of this industry should understand that the invention is not limited to the embodiments above. The purpose of embodiments and details description is only to illustrate the principles of the invention. According to its objectives and scope, the invention will have various changes and improvements. The changes and improvements will be included in the scope of the invention. The claimed scope of the invention is determined by the appended claims and their equivalents.

The invention claimed is:

1. A long-service-life PWS cable with a replaceable sleeve and shielding gas, which consists of wire strands (1), wrapping tape (2) covering the wire strands (1), and sheath (3) arranged outside the wire strands (1), is characterized in that the sheath (3) is covered with an outer protective sleeve (4), and shielding gas (5) is filled between the wires in the wire strands (1); and the outer surface of the wire constituting the wire strands (1) is provided with a protective layer (6), and the shielding gas (5) is filled between the wires in the wire strands (1), and the sheath (3) is a permanent structure, and the outer protective sleeve (4) is a replaceable structure.

2. The long-service-life PWS cable with a replaceable sleeve and shielding gas according to claim 1, is characterized in that the outer protective sleeve (4) comprises at least two tube segments (4.1) connected to form a tube, the adjacent tube segments (4.1) have connection structure between them.

3. The long-service-life PWS cable with a replaceable sleeve and shielding gas according to claim 1, is characterized in that the outer protective sleeve (4) comprises a plurality of sleeve units spliced and connected in the axial direction.

4. The long-service-life PWS cable with a replaceable sleeve and shielding gas according to claim 1, is characterized in that the outer protective sleeve (4) is installed after the cable erected and fitted with the sheath (3), and the outer protective sleeve (4) can be replaced separately.

5. The long-service-life PWS cable with a replaceable sleeve and shielding gas according to claim 2, is characterized in that the connecting structure includes a bayonet connecting portion (4.2) provided between two tube segments (4.1).

6. The long-service-life PWS cable with a replaceable sleeve and shielding gas according to claim 2, is characterized in that the connection structure includes a hinge connection structure between two tube segments (4.1) and a bayonet connection portion (4.2).

7. The long-service-life PWS cable with a replaceable sleeve and shielding gas according to claim 2, is characterized in that the tube segments (4.1) are provided with electric heating element (4.5) for bonding and connecting the tube segments (4.1).

8. The long-service-life PWS cable with a replaceable sleeve and shielding gas according to claim 2, is characterized in that the tube segments (4.1) are provided with a plurality of lamp installation slots (4.6) to facilitate lamp installation.

9. The long-service-life PWS cable with a replaceable sleeve and shielding gas according to claim 2, is characterized in that the tube segments (4.1) are provided with a plurality of weight-reducing holes (4.7) where heating unit can be installed.

10. The long-service-life PWS cable with a replaceable sleeve and shielding gas according to claim 1, is characterized in that it further comprises anchors (7), which are arranged at both ends of the wire strands (1) and the sheath (3), the wire strands (1) between the two ends of the sheath (3) or between the two anchors (7) is in the enclosed space where the shielding gas (5) is filled in.

11. The long-service-life PWS cable with a replaceable sleeve and shielding gas according to claim 1, is characterized in that a pressure sensor (8) for detecting the pressure of the shielding gas (5) is provided.

12. The long-service-life PWS cable with a replaceable sleeve and shielding gas according to claim 1, is characterized in that the sheath (3) and/or the anchors (7) are connected to the inflation tube (10).

13. The long-service-life PWS cable with a replaceable sleeve and shielding gas according to claim 1, is characterized in that the inflation tube (10) is connected with the inflation device (9) to supply shielding gas (5) to the inside of the wire strands (1).

14. The long-service-life PWS cable with a replaceable sleeve and shielding gas according to claim 1, is characterized in that the outer protective sleeve (4) is installed after the cable erected and fitted with the sheath (3), and the outer protective sleeve (4) can be replaced separately.

15. The long-service-life PWS cable with a replaceable sleeve and shielding gas according to claim 2, is characterized in that the outer protective sleeve (4) is installed after the cable erected and fitted with the sheath (3), and the outer protective sleeve (4) can be replaced separately.

16. The long-service-life PWS cable with a replaceable sleeve and shielding gas according to claim 5, is characterized in that the tube segments (4.1) are provided with electric heating element (4.5) for bonding and connecting the tube segments (4.1).

17. The long-service-life PWS cable with a replaceable sleeve and shielding gas according to claim 4, is characterized in that the tube segments (4.1) are provided with electric heating element (4.5) for bonding and connecting the tube segments (4.1).

18. The long-service-life PWS cable with a replaceable sleeve and shielding gas according to claim 9, is characterized in that a pressure sensor (8) for detecting the pressure of the shielding gas (5) is provided.

19. The long-service-life PWS cable with a replaceable sleeve and shielding gas according to claim 9, is characterized in that the sheath (3) and/or the anchors (7) are connected to the inflation tube (10).

20. The long-service-life PWS cable with a replaceable sleeve and shielding gas according to claim 9, is characterized in that the inflation tube (10) is connected with the inflation device (9) to supply shielding gas (5) to the inside of the wire strands (1).

* * * * *